US006570501B2

(12) United States Patent
Bushnell et al.

(10) Patent No.: US 6,570,501 B2
(45) Date of Patent: May 27, 2003

(54) HAND GUN CASE

(76) Inventors: Raymond B. Bushnell, 25023 Beesen Rd., Beaver Creek, OR (US) 97004; Danny R. Lewis, 25023 Beesen Rd., Beaver Creek, OR (US) 97004

( * ) Notice: Subject to any disclaimer, the term of this patent is extended or adjusted under 35 U.S.C. 154(b) by 0 days.

(21) Appl. No.: 09/962,284

(22) Filed: Sep. 24, 2001

(65) Prior Publication Data

US 2003/0057122 A1 Mar. 27, 2003

(51) Int. Cl.[7] ..... E05B 45/06

(52) U.S. Cl. ..... 340/542; 340/5.7; 340/5.73; 340/5.8; 340/5.81; 340/5.82; 340/5.83; 206/317; 206/1.5

(58) Field of Search ..... 340/542, 5.73, 340/5.7, 5.8, 5.81, 5.82, 5.83; 206/317, 1.5

(56) References Cited

U.S. PATENT DOCUMENTS 1,557,339 A 10/1925 Szender ..... 224/542
5,161,396 A 11/1992 Loeff ..... 70/63
5,189,894 A 3/1993 Buck ..... 70/63
5,449,103 A 9/1995 Tilley ..... 224/244
5,579,909 A 12/1996 Deal ..... 206/317
5,701,779 A 12/1997 Cook ..... 72/356

*Primary Examiner*—Daryl Pope
(74) *Attorney, Agent, or Firm*—Robert L. Harrington; Schwabe Williamson & Wyatt, P.C.

(57) ABSTRACT

A hand gun case body that is fully enclosed except for a door opening including a hinged door that latches to the case to close the opening. A slide inside the case body slides into and out of a door opening and carries a hand gun that is accordingly transferred between positions of containment within the case body and accessibility outside the case body. A biasing member urges the slide to the accessibility position when the door is opened. The biasing member is remote from the hand gun and avoids interference with said accessibility. The latch is actuated by a personal feature recognition device, e.g., a fingerprint recognition device and upon presentation of said personal feature to said device, said door is unlatched and the hand gun is presented to an authorized user.

14 Claims, 6 Drawing Sheets

HAND GUN CASE

FIELD OF THE INVENTION

This invention relates to the gun locking and security field and more particularly to a safe and secure case for a loaded hand gun that allows an authorized user rapid, unobstructed and effortless access to the hand gun.

BACKGROUND OF THE INVENTION

Crime and violence is not confined to the urban environment, but also persists throughout suburban and rural communities. As a result, there exist a large and expanding segment of the population who choose to own hand guns for self-protection, protection of others and protection of property. For this population, immediate and unrestricted access to the hand gun is crucial, since the need typically arises only in an emergency situation, such as when an intruder enters ones dwelling. Thus, anything less than free, open, unobstructed and immediate access to the hand gun defeats the primary purpose of owning the hand gun, i.e., protection.

Wide spread gun ownership has increased the number of accidents or incidents involving the use of the hand gun by an unauthorized person. Just as the population of gun owners is growing, a strong movement to protect innocent third parties, such as children, from the dangers of an accessible loaded hand gun is gaining momentum. Children in particular are intrigued by guns and have fallen victim to accidental shootings because the gun owner has taken less than adequate measures to secure the hand gun. Just as tragic is the unfortunate trend involving school shootings, which may have been prevented had the gun owner taken measures to prevent access to the hand gun by unauthorized persons. Thus, the safety-conscious segment of the population demand virtually infallible security and safety measures to prevent the unfortunate consequences that can arise from unauthorized access to a hand gun.

Until now, no one has been able to solve the problem of effectively marrying the two competing interests of accessibilIty and safety demanded by the seemingly opposing population segments discussed above. The present invention solves this problem by offering a hand gun case that is safe and secure from unauthorized access without sacrificing rapid and unobstructed accessibility when the need arises.

BRIEF SUMMARY OF THE INVENTION

The present invention solves the aforementioned problems and meets the aforementioned needs by providing a secure rapidly accessible two-part impregnable gun case that uses feature recognition to allow an authorized user immediate and unobstructed access to a hand gun.

In the preferred embodiment, a gun case is made out of a lightweight material, such as plastic, reinforced with embedded belts that cannot be readily cut. One end of the case has an access cover that is hingably attached to the case. The case attaches Lo a fixed energized base through the use of a locking mechanism that prevents the case from being moved without unlocking it from the base. The two-part case allows the user to remove the case from the base, transport and attach the case to a fixed base in a different location, such as in a motor home or vacation property. This feature facilitates portability of the case without sacrificing safety and security.

Enclosed in the case is a slide mechanism that supports the hand gun and projects it out of the case when the access door opens. The access cover opens when the lock is activated by a feature recognition system's identification of an authorized user's feature. It is the preferred embodiment of this invention to use fingerprint recognition, but other forms of feature recognition can be used such as voice activation.

The invention involves security measures used to meet the needs of the safety-conscious population. The case locks to a base that is securely attached to a surface in a location chosen by the authorized user. This prevents removal without unlocking the case. This is an improvement over the prior art, which generally cover secure cases that are not fixed to a surface. If an unauthorized person attempts to cut through the case or forcibly remove the case from the base, an audible alarm will sound. A further safety measure includes strategic placement within the case of a material, such as LEXAN, to absorb a bullet if the gun accidentally fires.

The invention also involves features that meet the gun owner population's demands of immediate and unobstructed access to the hand gun by using a fully enclosed spring loaded adjustable slide mechanism, which projects the gun out of the case when the access door is opened. This allows the authorized user clean, immediate and properly oriented access to the hand gun in an emergency. The gun attaches to the slide by the use of an interchangeable dowel sized to fit a particular caliber of gun. The position of the slide is adjustable depending on the size of the gun. It is desirable that the butt of the gun be located just behind the access cover so the gun projects out to maximum reach. The springs in the slide are enclosed within the slide unit and there is no support to the butt of the gun, thus once projected, the user may cleanly grab the gun.

The present invention also caters to both the gun owner and safety conscious population by providing immediate, unobstructed, yet secure access to the hand gun through the use of feature recognition to activate the lock securing the case access cover. In the preferred embodiment, when an emergency arises, the authorized user can touch a reader board mounted on the case. If the person's print is recognized as an authorized print, it Will activate a solenoid and unlock the access cover. This is an improvement over the prior art that teaches using a key or combination lock to prevent access by an unauthorized user. In a panic situation, fumbling with a key, possibly in the dark, or trying to remember a combination, code or sequence of button depressions is cumbersome, time consuming, and potentially life threatening. This invention also is an improvement over the prior art that teaches using a fingerprint recognition system because the prior art, requires the user to, once he or she has properly deactivated the locking mechanism, affirmatively reach into the container to retrieve the hand gun. This too, is cumbersome and time consuming depending on the orientation of the hand gun, and may also be life threatening. The feature recognition system is energized by a constant power source provided to the base, or in the event of an interruption of this source, i.e. power failure, the case contains a rechargeable battery source. A key activated manual override is provided in case there may be total failure or the energy source.

The present invention is an improvement over known prior art with particular reference to U.S. Pat. No. 1,557,339 issued to Sander. Sander describes a spring-loaded plate that attaches to both the butt and barrel of the gun, and projects the hand gun when the access door is opened. In Sander, the projecting springs are exposed and encumber access to the gun. Also, the gun butt is cradled by a two-piece mounting bracket that, due to the upturned ends, obstructs clean access to the gun and sacrifices speed.

Accordingly, it is a principal object of the present invention to provide an improved gun case that meets the competing societal demands of providing a secure, tamper. resistant, safe gun case without sacrificing unobstructed access to the hand gun.

It is a further object of the preferred embodiment to accommodate portability of the case without sacrificing security or safety.

The foregoing and other objects, features and advantages of the invention will be more readily understood upon consideration of the following detailed description of a preferred embodiment of the invention, taken in conjunction with the following drawings.

DETAILED DESCRIPTION

Figure 1:
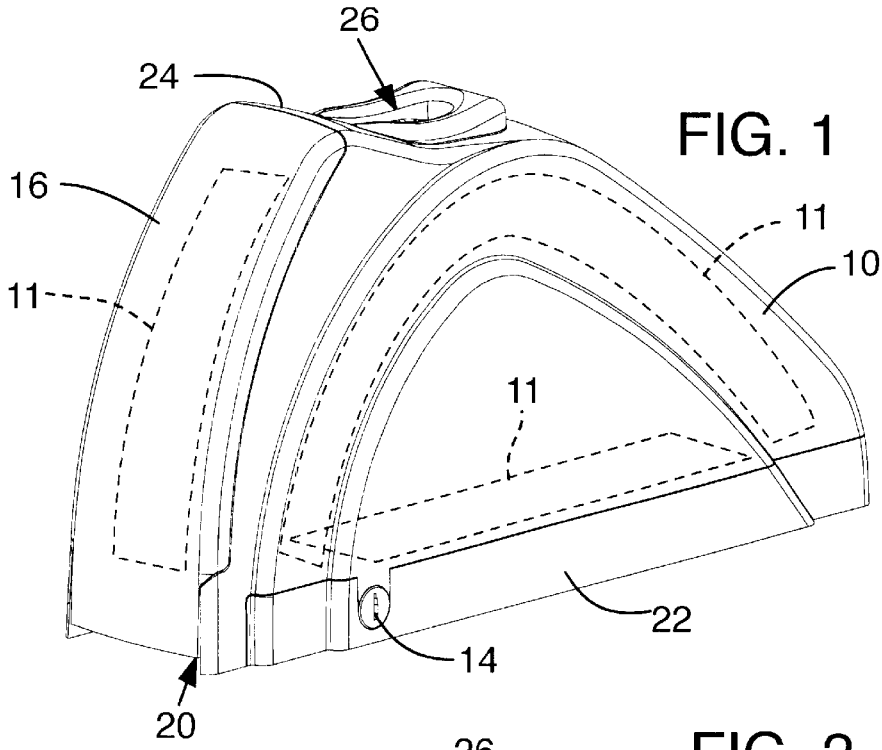
FIG. 1 is a perspective illustration of a rapid access secure gun case and mounting mechanism in accordance with the invention.

FIG. 1 illustrates a secure hand gun case of the present invention. The case 10 is made of a lightweight impregnable material that, in this embodiment, is reinforced with virtually unseverable webbing or belting. The belting may be applied to the case in various patterns and the dash lines 11 merely illustrate a possible pattern of such belting. By itself, the case 10 is freely transportable. The case 10 can be securely attached to the base 12 (see FIG. 2) through the use of a base locking mechanism 14. The base 12 is itself secured to a night stand, end table or the like by fasteners 15. The hand gun owner may unlock the locking mechanism 14 using a key, remove the case 10 from the base 12, transport the case securely containing the hand gun 18, and lock the case 10 to a different fixed base 12 at another location.

The case 10 has an access cover 16 that, when in the closed position, prevents access to the Hand gun 18. The access cover 16 is locked in the closed position by a locking mechanism 24 to be described in more detail later. The locking mechanism 24 is activated by a feature recognition device 26, such as a fingerprint scanner as depicted in the preferred embodiment.

Figure 2:
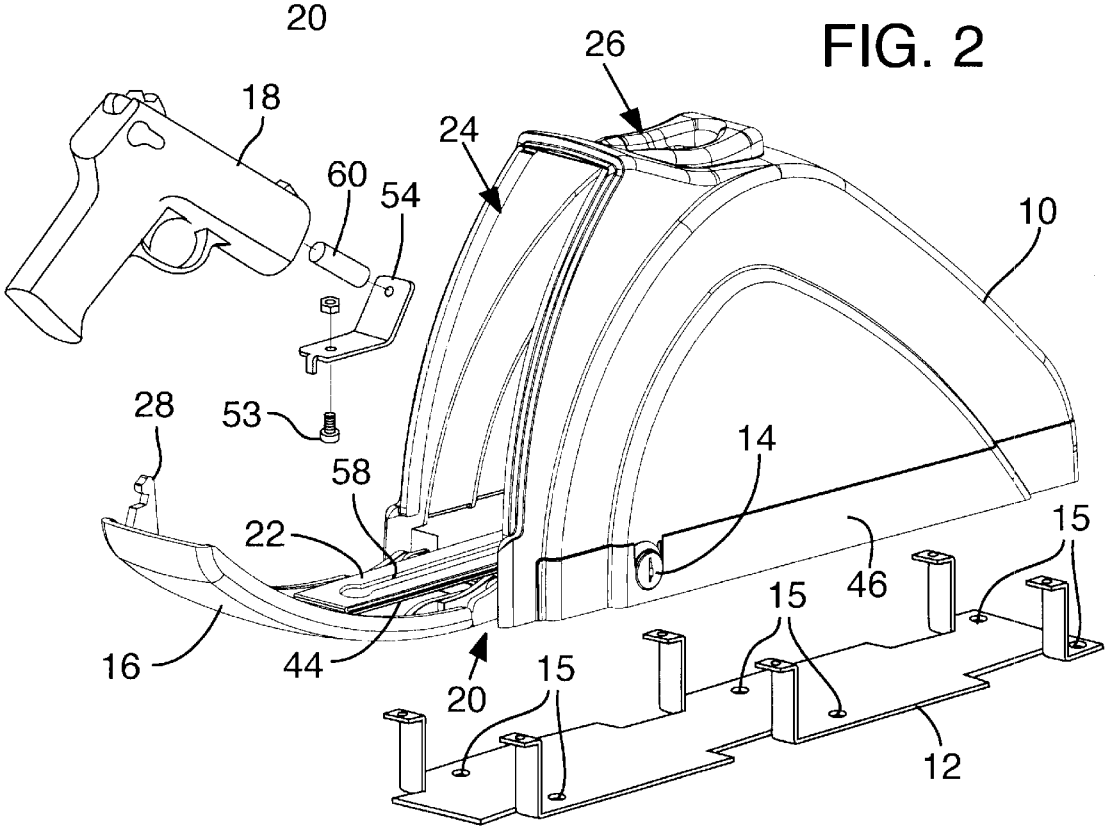
FIG. 2 is a perspective illustration of the rapid access secure gun case of FIG. 1 in an open position showing a hand gun and the manner of mounting the hand gun to the case and the case to a base.
Figure 5:
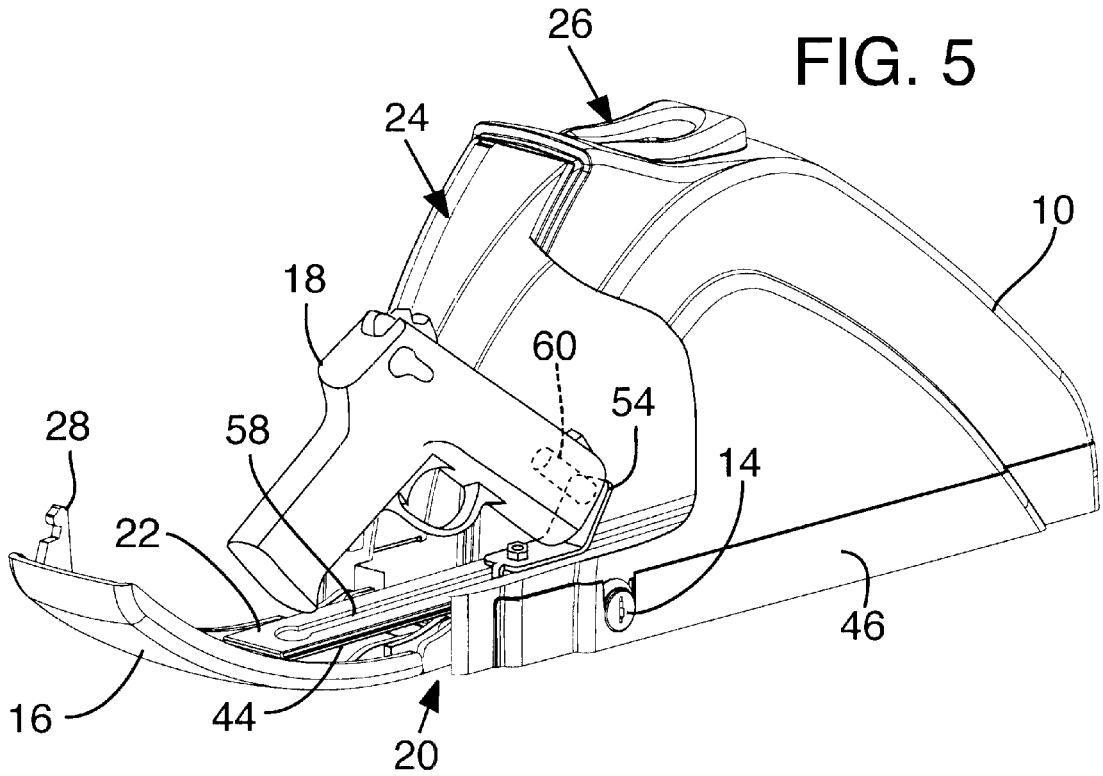
FIG. 5 is a perspective illustration of a hand gun mounted to the slide mechanism at its full extension from the gun case.

FIG. 2 is an exploded view that depicts the rapid access secure gun case with the access cover 16 in the open position and the hand gun 18 projected out of the case 10 in exploded view but see also FIG. 5. In the preferred embodiment, the access cover 16 is hingably attached by hinges 20 at the bottom rear portion of the case 10 and opens downward and rearward. The access cover 16 has a latch 28 that allows the access cover 16 to be retained in a closed and secure position when the hand gun is not required. As noted from FIG. 5, the hand gun 18 is mounted on a spring loaded slide mechanism 22 that is preloaded when the access cover 16 is in its closed and locked position. When an authorized user unlatches the locking mechanism 24, the stored energy in the preloaded slide mechanism projects rearward thus forcing the access cover 16 to flip open and the hand gun 18 to be projected out of the case 10 making the hand gun 18 accessible to the authorized user. The hingable attachment 20 may also be spring loaded so that when the locking mechanism 24 is unlatched, the stored energy in the spring of attachment 20 will assist the access cover 16 to open.

It is equally understood by those skilled in the art that the access cover 16 could be located and hingably attached to the top of the case 10 and would flip to the side or forward to allow the hand gun 18 to project upward out of the case giving the authorized user immediate and unobstructed access to the hand gun 18.

FIGS. 3, 3A, 4, 4A and 4B are detailed illustrations of the internal mechanism of the case. The locking mechanism 24 keeps the access cover 16 in a closed and secure position until the feature recognition device recognizes a pre-identified feature of an authorized user. In the preferred embodiment described herein, a fingerprint reading device 30 is used as the feature recognition device to confirm whether or not a user is an authorized user with rights to access to the hand gun. To those skilled in the art, however, modifications and variations are within the contemplation and scope of the invention, such as by using a voice activated recognition system.

Figure 3:
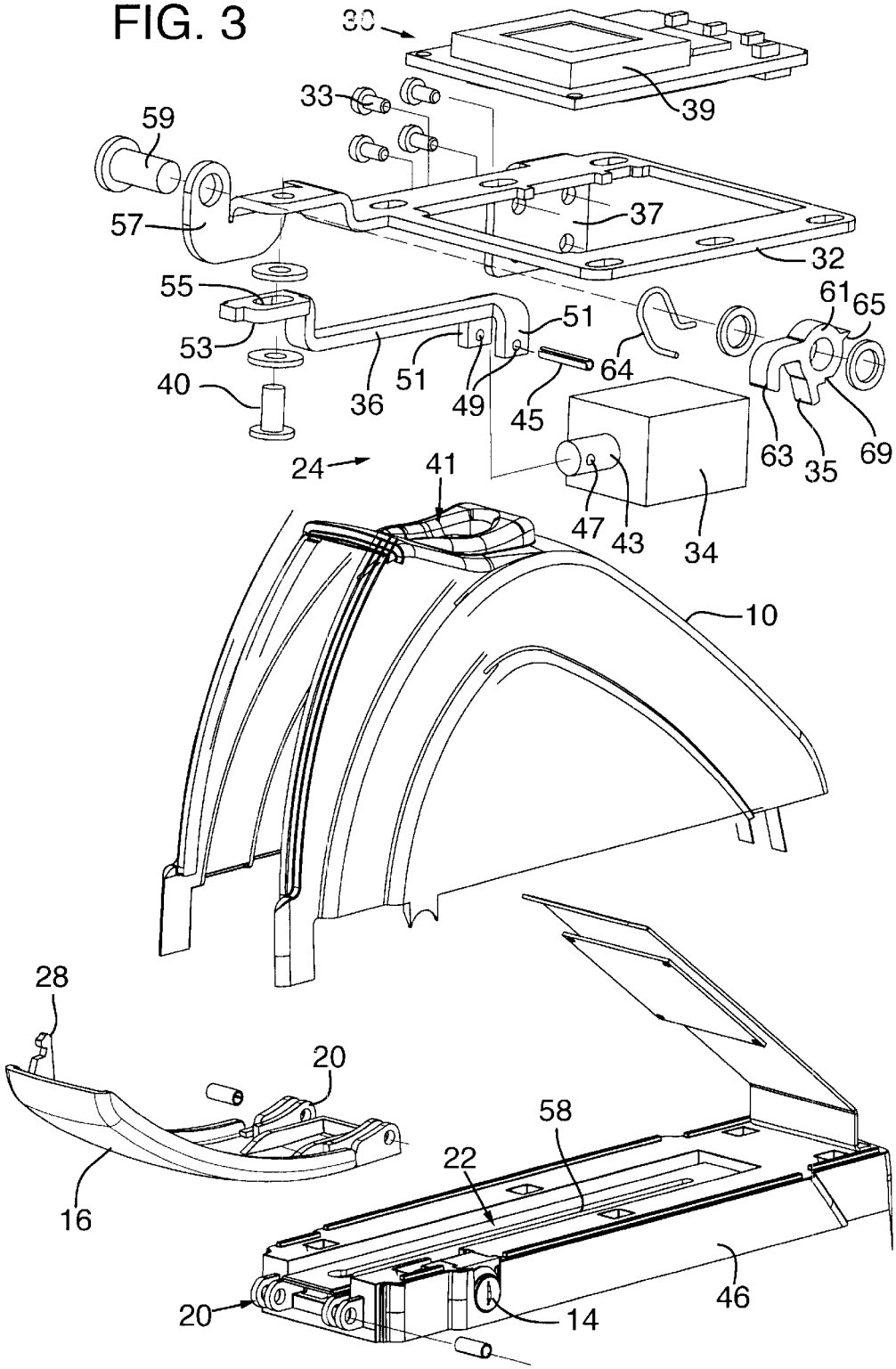
FIG. 3 is an exploded perspective illustration of the fingerprint scanner and the solenoid lock mechanism contained in the gun case of FIG. 1.
Figure 3A:
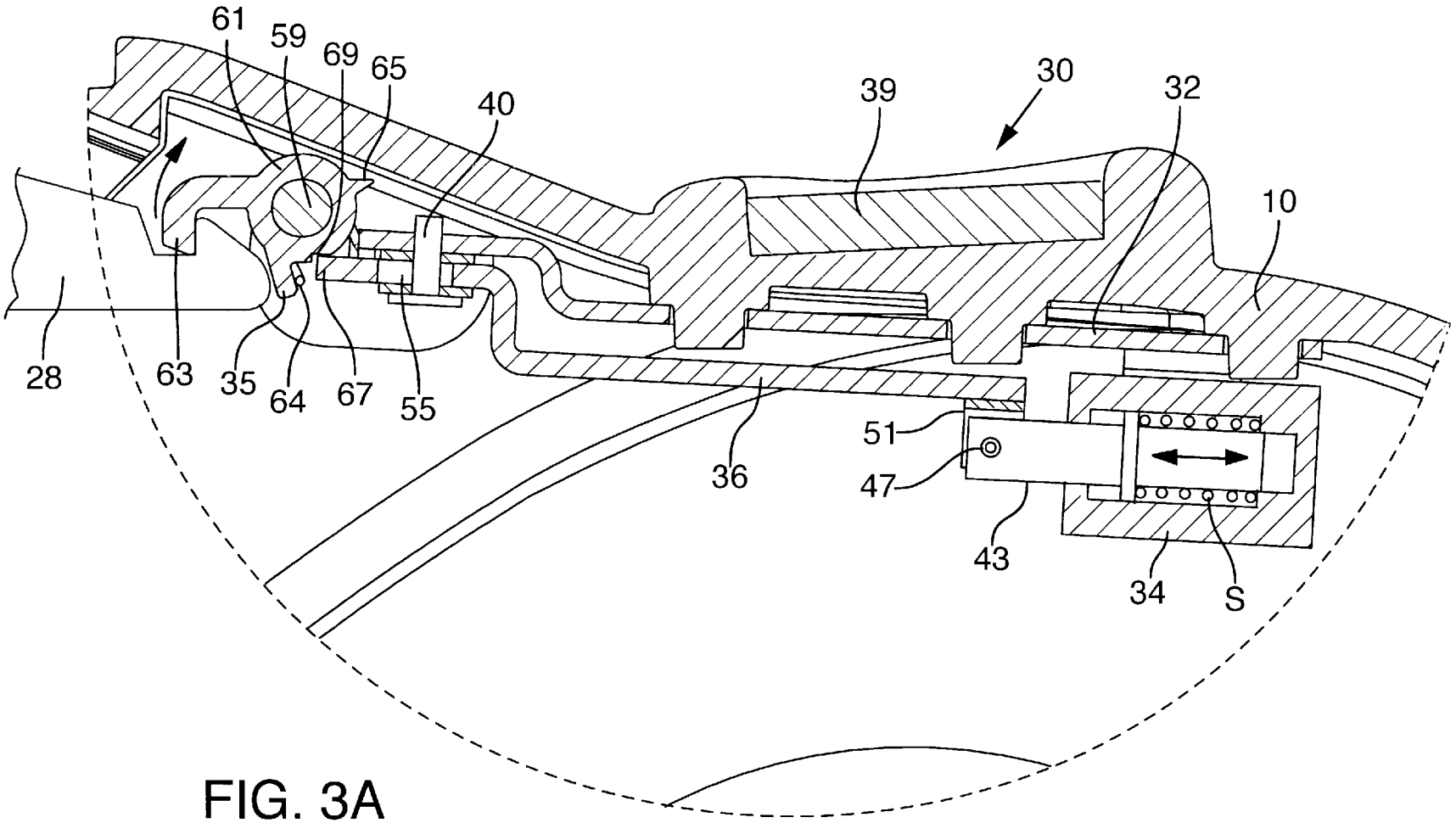
FIG. 3A is a cross section view of the operating components of the lock mechanism of FIG. 3.

As depicted in FIGS. 3 and 3A, the fingerprint reader device 30 is mounted to the case 10 though the use of a reader board lock mount 32. Lock mount 32 is fixed to case 10 with bolts 33 protruded through flange 37 and into a wall of case 10. The reader board 30 is assembled to the lock mount 32 as necessary to project the recognition screen 39 through the window 41 formed in the case 10.

Also mounted to the case 10 is a solenoid having a fixed housing 34 and a slidable plunger 43. Upon receiving an electrical impulse, the plunger is retracted (moves inwardly) into solenoid housing 34. The plunger 43 is provided with a pin connection to lock arm 36 via pin 45 passing through hole 47 of the plunger 43 aligned between holes 49 of fork 51 provided on one end of the lock arm 36. Thus an electrical impulse applied to the solenoid produces retraction of lock arm 36. The opposite end 53 of lock arm 36 is configured to have a slot 55 through which pin 40 is projected and secured to lock mount 32. The slot permits limited axial movement of the arm 36 relative to pin 40 and lock mount 32.

A bracket portion 57 of lock mount 32 receives a bearing pin 59 which pivotally supports pivotal latch member 61 having lug 35 and latch hook 63. Spring 64 biases latch member 61 in the clockwise direction, i.e., in a direction where latch hook 63 disengages from cover latch 28. Lock arm 36 is biased toward member 61 by a spring S inside solenoid housing 34 and nose portion 67 of arm 36 is seated in notch 69 to prevent clockwise rotation of member 61 and thereby retains the locked position. Energizing solenoid 34 produces retraction of plunger 43 to allow the spring 64 to disconnect latch hook 63 from cover latch 28 and thus opening of cover 16. By manually closing the cover, the cover latch 28 engages lug 35 to force counter clockwise rotation of member 61 until the spring biased lock arm 36 again nests in notch 69 whereat latch hook 63 again secures the cover 16 in the locked position.

In operation, a would-be authorized user places a finger or thumb on the exposed portion of the reader board 30, which scans the print and compares it to authorized fingerprint maps digitally stored in the memory of the reader board 30. If the user's print matches a stored authorized print, he or she is recognized as an authorized user and an impulse signal is sent to a normally de-energized solenoid 34. Once energized, the cover is unlocked as explained above to decouple hook 63 from the cover latch 28. De-energizing the solenoid returns control of the lock arm positioning to the inner spring S of the solenoid housing 35 which projects into engagement with member 61. Upon closure of the cover 16, the lock member 61 is rotated against the urging of spring 64 to align notch 67 with the nose end of lock arm 36 which enters the notch 67 and provides relocking of cover 16.

There are several available power sources for the finger print reader board 30. In the preferred embodiment described herein, the power source is a rechargeable battery pack 42 housed in the slide mechanism 22. (See FIG. 4A) The base 12 may be directly energized and keep the rechargeable battery pack constantly charged. Solar cells can also be mounted on the outside of the case to supply energy to the rechargeable battery pack. In case of a total power failure, the access cover 16 may still be unlocked, e.g., by using the case from base 12 and with the bottom of the case exposed having provided thereat access to the lock arm 36 to force the lock arm 36 against the urging of the inner spring in the solenoid case to thereby allow opening of cover 16.

FIGS. 3, 4, 4A and 4B illustrate the spring slide mechanism 22 and related components that projects the hand gun 18 out of the case 10. As more fully depicted in the exploded views of FIGS. 4A and 4B, a slotted hand gun slide 44 slides within the slide base 46. Housed within the slide base 46 and connected to the underside of the hand gun slide 44 are two opposing springs 48 and 50. The compression spring 48 is responsible for projecting the hand gun slide 44 rearward out of the slide base 46, and thus rearward out of the case 10. The extension spring 50 opposes the compression spring 48 to slow the projection of the hand gun slide 44 as it reaches maximum extension out of the slide base 46 so as to avoid jarring stops that might dislodge the gun from the slide. Both springs 48 and 50 are fully enclosed within the slide base 46 and the bottom spring cover 52. (See FIG. 4B) Energy is stored in the compression spring 48 as the slide 44 is manually slid into the slide base 46 against the biasing of spring 48 and retained in such a position by the closure of the access cover 16. When the access cover 16 is unlocked by an authorized user, the force of the compression spring 48 causes the access cover 16 to open and the hand gun slide 44 to project the hand gun 18 out of the case 10. As the slide 44 reaches its fully extended position, the increased resistance of spring 50 counteracts the rearward movement of the slide to provide both rapid but not jarring full retraction of the slide. The compression spring is stronger than the extension spring even at full opening of the cover 16 whereby the cover 16 is maintained in the opened position until manually closed.

Figures 4, 4A:
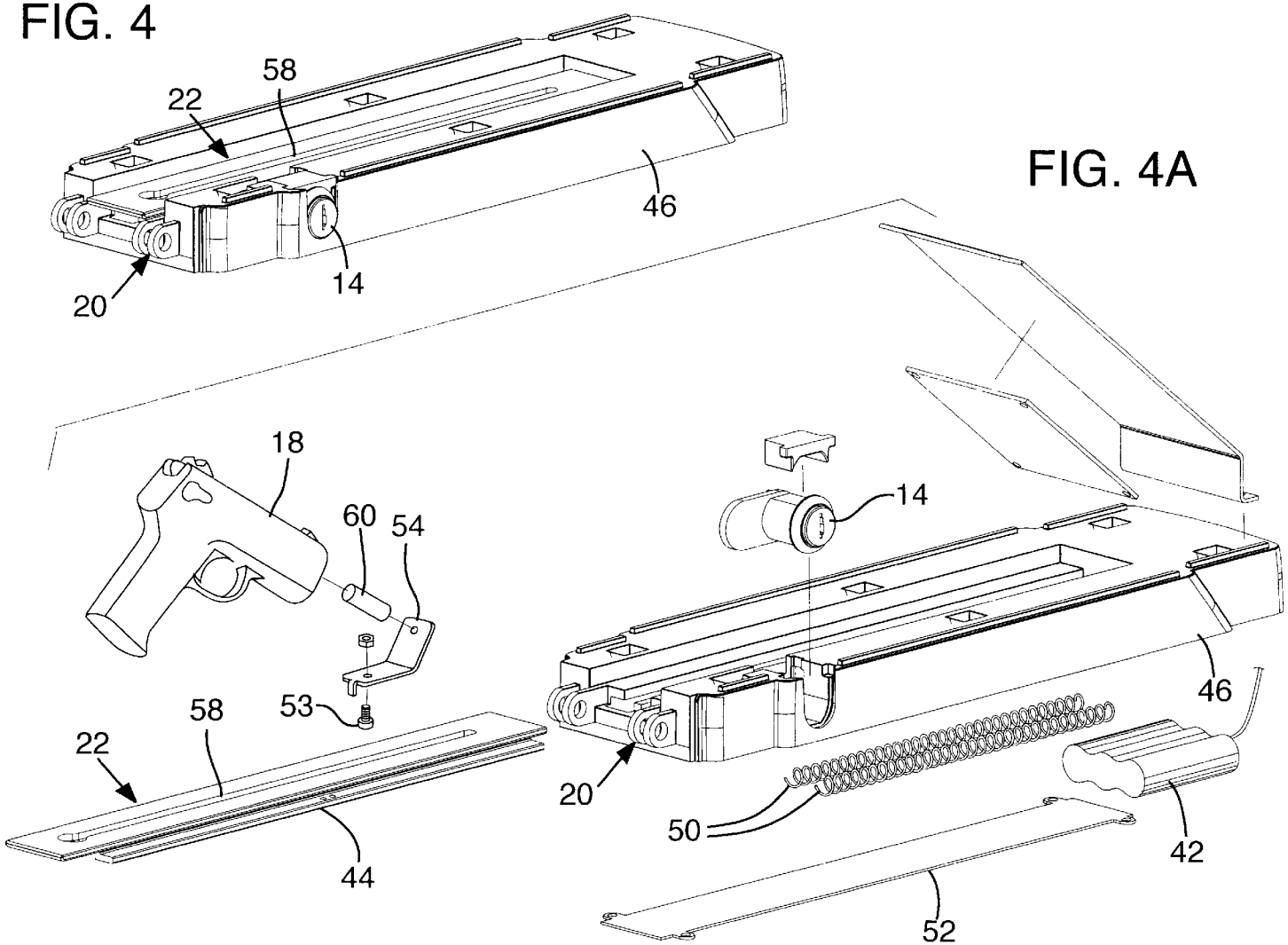
FIG. 4 is a perspective illustration of the slide mechanism to which a hand gun is mounted within the gun case of FIG. 1.
FIG. 4A is a top view perspective illustration of the operating components of the slide mechanism of FIG. 4.
Figure 4B:
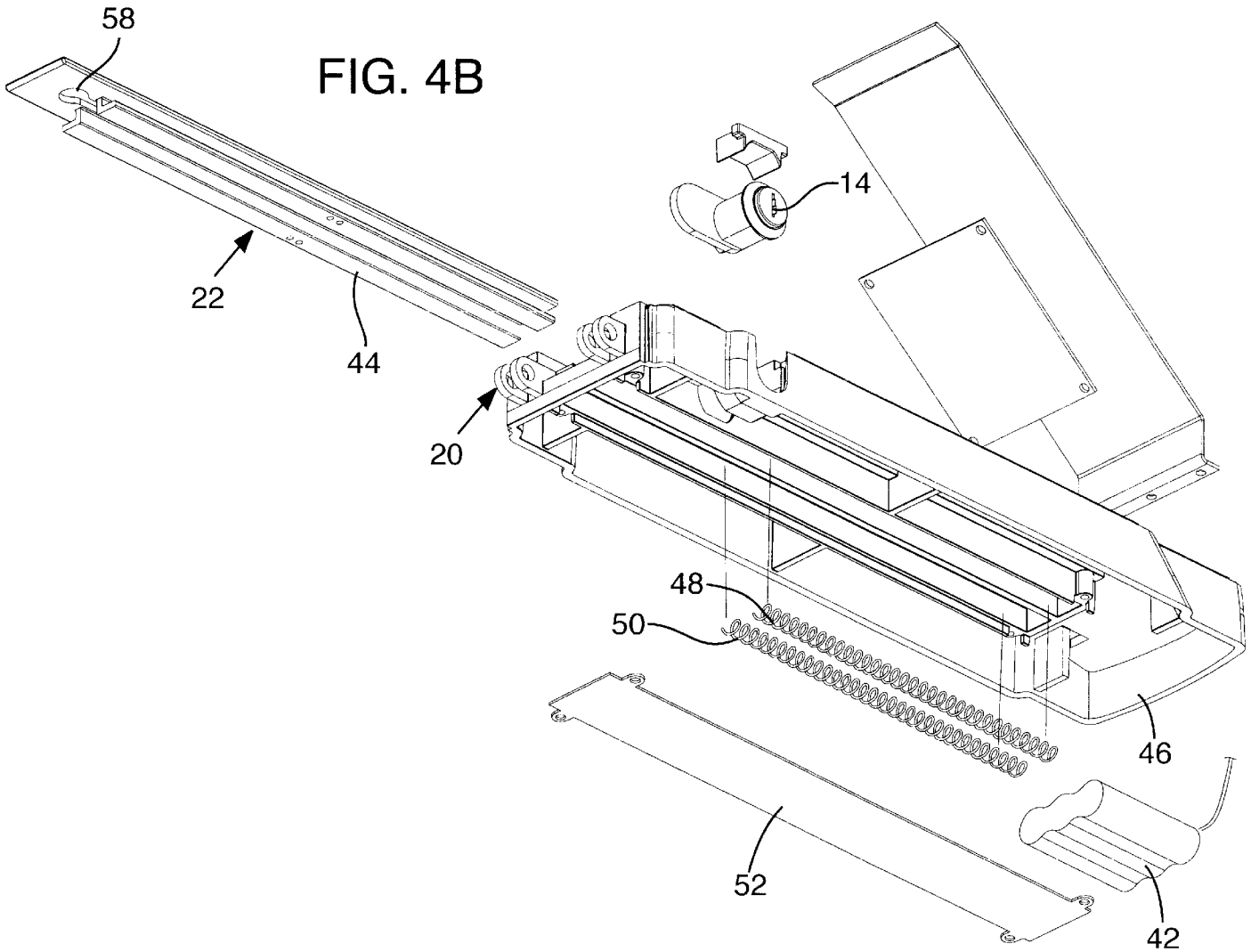
FIG. 4B is a bottom view perspective illustration of the operating components of the slide mechanism of FIG. 4.

With reference to FIGS. 2, 4A and 4B, an angular hand gun mount bracket 54 is adjustably mounted to the hand gun slide 44 by the mount bolt 53. The slot 58 running much of the length of the hand gun slide 44 allows the hand gun mount bracket 54 to be positioned on the hand gun slide 44 such that when the hand gun slide 44 is fully extended, the hand gun 18 is projected out of case 10 to the fullest extent allowing maximum accessibility. FIG. 5 depicts the hand gun 18 mounted to the hand gun slide 46 at its maximum extension.

The hand gun mount bracket 54 has a bore dowel 60 affixed to the front upward angled portion of the mount bracket 54. The bore dowel 60 supports the hand gun 18, yet it allows the authorized user to effortlessly remove the hand gun 18 from the bore dowel 60 once projected out of the case 10. The bore dowel 60 is removably attached to the mount bracket 54, and fully interchangeable to accommodate any caliber of hand gun.

Those skilled in the art will recognize that modifications and variations may be made without departing from the true scope and spirit of the invention. Some of these potential variations from the preferred embodiment have been identified above. The invention, therefore, is not to be limited to the embodiments described and illustrated, but is to be determined from the appended claims.

The invention claimed is:

1. A hand gun securable case comprising:

a case body having bottom, sides and top connected together and defining a case interior and a door opening to said case interior and otherwise said bottom, side and top cooperatively preventing access to said interior;

a door having a hinge connection to an edge portion of said case body defining in part said door opening and said door being pivotal about said hinge connection to an open position exposing said interior and a closed position closing said door opening and as closed preventing access to said case body interior;

a slide mechanism mounted in the case body and including a slide support that is movable by said slide mechanism from a position fully contained in the case body interior to a position at least partially extended through said door opening with the door in an opened position, a gun support carried by said slide support and configured to engage a barrel portion of a hand gun, the hand gun being slidably removable from said gun support;

a biasing member biasing the slide support to the position of at least partially extended through said door opening, said hand gun support and said slide support cooperatively arranged to project a hand gun having a barrel end and an opposed hand grip end carried by said hand gun support to a position protruded through said door opening with said slide support at said position of at least partially extended through said door opening, said hand gun oriented with the hand grip being the leading end of the hand gun projected out said opening;

a latch mechanism latching the door in the closed position, an actuator in the case body interior operable to unlatch the door, said actuator and said biasing member cooperatively opening said door when unlatched and effecting slidable movement of a hand gun mounted to the hand gun support from said case body interior; and a personal feature recognition device associated with said actuator and initiating unlatching of the door when exposed to said feature of an authorized user.

2. A hand gun securable case as defined in claim 1 wherein the personal feature recognition device is a fingerprint recognition device whereby placement of an authorized user's fingerprint onto the device actuates said actuator.

3. A hand gun securable case as defined in claim 1 wherein the case body includes a back side that extends from the bottom and angles inwardly toward the top, said door opening being formed in said back side and the hinge connection provided adjacent the bottom and the door extended upwardly and inwardly when closing the door opening;

said slide mechanism formed along the case body bottom, and the slide support sliding against said door when unlatched to pivot the door rearwardly and downwardly with the slide support extended over the door in the opened position;

said gun support supporting the hand gun with the hand grip projected rearwardly and upwardly as supported by said gun support.

4. A hand gun securable case as defined in claim 3 wherein the biasing member is opposing springs including a compression spring and a tension spring, the compression spring urging the slide support for rapid movement of the slide support and hand gun through the opening and the tension spring urging a braking action near the full extension of the slide support.

5. A hand gun securable case as defined in claim 4 wherein the slide support overlies the opposing springs and the gun support overlies the slide support.

6. A hand gun securable case as defined in claim 5 wherein the gun support includes a dowel angled rearwardly and upwardly on said gun support, said hand gun having its barrel end positioned onto the dowel.

7. A hand gun securable case as defined in claim 6 wherein the gun support is adjustably secured to said slide support, said adjustment extending along the direction of movement whereby different gun lengths can be accommodated, and said dowel being removable and replaceable with different sized dowels to accommodate different gun barrel dimensions.

8. A hand gun securable case as defined in claim 1 wherein a base member is securable to a substantially non-movable member, and said case body is removably securable to said base, and a locking feature provided to releasably lock said case body to said base member.

9. A hand gun securable case as defined in claim 8 wherein a plurality of base members are securable to a plurality of substantially non-movable members at different locations to enable said case body to be transferred to and securable to a selected base member at any of said different locations.

10. A hand gun securable case as defined in claim 1 wherein cut resistant belts are imbedded in said sides and top of said case body.

11. A hand gun securable case as defined in claim 10 wherein an alarm is provided in the case that is activated by attempts to breach said case body.

12. A hand gun securable case as defined in claim 11 wherein the alarm and actuator are electronically actuated, and a power source of electricity provided to said case.

13. A hand gun securable case as defined in claim 12 wherein a rechargeable battery provides said power source.

14. A hand gun securable case as defined in claim 13 wherein a secondary power source is provided to said case body in the form of an electrical conduit provided from an electrical outlet.

* * * * *